US007356934B2

(12) United States Patent
McCambridge et al.

(10) Patent No.: US 7,356,934 B2
(45) Date of Patent: Apr. 15, 2008

(54) BELT OR CLOTHING-MOUNTABLE BATTERY-POWERED HAIR CLIPPER WITH HOLSTER

(75) Inventors: James E. McCambridge, Polo, IL (US); Luther D. Langley, Sterling, IL (US)

(73) Assignee: Wahl Clipper Corporation, Sterling, IL (US)

( * ) Notice: Subject to any disclaimer, the term of this patent is extended or adjusted under 35 U.S.C. 154(b) by 434 days.

(21) Appl. No.: 10/999,042

(22) Filed: Nov. 29, 2004

(65) Prior Publication Data

US 2006/0112572 A1 Jun. 1, 2006

(51) Int. Cl.
*B26B 19/38* (2006.01)

(52) U.S. Cl. ..... 30/537; 30/151; 206/351; 224/680

(58) Field of Classification Search ..... 206/351; 224/680, 930; 30/537, 151
See application file for complete search history.

(56) References Cited

U.S. PATENT DOCUMENTS

| | | | | |
|---|---|---|---|---|
| 2,625,192 A | | 1/1953 | Kinskie | |
| 2,688,427 A | | 9/1954 | Simons | |
| D262,678 S | | 1/1982 | DeBoer | |
| 4,923,394 A | * | 5/1990 | Fumino | 431/343 |
| 5,054,672 A | | 10/1991 | Weissman | |
| 5,511,705 A | * | 4/1996 | Dreszer | 224/666 |
| 5,787,601 A | | 8/1998 | Stelly | |
| 6,443,343 B2 | * | 9/2002 | Kamiya | 224/269 |
| D514,806 S | * | 2/2006 | McCambridge et al. | D3/228 |
| 7,032,791 B2 | * | 4/2006 | Stotts | 224/269 |
| 2005/0185403 A1 | * | 8/2005 | Diehl | 362/259 |

FOREIGN PATENT DOCUMENTS

| | | |
|---|---|---|
| DE | 8614677.7 | 5/1986 |
| DE | 19858382 A | 10/1999 |
| EP | 1108505 A | 6/2001 |
| JP | 200164182 A | 11/1998 |

* cited by examiner

*Primary Examiner*—Kenneth E. Peterson
(74) *Attorney, Agent, or Firm*—Greer, Burns & Crain, Ltd.

(57) ABSTRACT

A hair clipper assembly configured for attachment to a user's clothing, including a battery pack having a housing at least one battery, a belt clip, and a holster recess; a holster having a holster belt clip; a hair clipper configured to slidably fit within the holster; and a cord connecting the clipper to the battery pack.

5 Claims, 5 Drawing Sheets

BELT OR CLOTHING-MOUNTABLE BATTERY-POWERED HAIR CLIPPER WITH HOLSTER

BACKGROUND OF THE INVENTION

The present invention relates generally to hand-held hair care appliances, such as electric hair clippers and trimmers, and more particularly, to battery-powered hand-held hair clippers. Specifically, the present battery-powered hair clipper assembly relates to improvements in the mobility, clipper run-time and range of movement of the user during operation of the hair clipper.

Hand-held hair clippers are well known in the beauty salon, barber shop and animal grooming industries. Although conventional hand-held hair clippers have advantages, they also have several limitations. First, if the hair clipper is electrically powered by line voltage, the stylist is limited in his/her movement because the cord for the clipper is connected to a wall outlet. Therefore, the stylist can only move so far as the cord can extend. In addition to being limited in range of movement, in some cases the cord interferes with the user's movements. For instance, the cord can be caught on the stylist's chair or the client's body.

Furthermore, present electrically-powered hair clippers powered by line voltage do not allow the stylist to easily multi-task. For instance, if a stylist is trimming a client's hair with the hair clipper and needs to switch to styling shears, needs to attend to hair care needs of another customer, or has to answer the telephone, the hair clipper needs to be put down and placed within the range of its cord. This reduces the stylist's efficiency. Finally, if a power outage were to occur during operation of the electrically-powered clipper, it would no longer operate.

To address these problems, battery-powered hair clippers were developed. Battery-powered hair clippers generally contain an in-unit battery. Although this seemed to solve the mobility and power outage problems encountered with line cord-powered hair clippers, the addition of an in-unit battery increases the weight and size of the hair clipper. To minimize the additional size and weight of the clipper, the in-unit battery of these hair clippers is generally small. As a result, the battery must be recharged quite frequently, reducing both the run-time of the hair clipper, and the stylist's efficiency.

Also, present battery-powered hair clippers do not allow the stylist to move freely around the salon and relatively easily multi-task. For instance, present battery-powered hair clippers do not allow the stylist to switch from using the hair clipper to styling shears, a blow-dryer or another hair care utensil without first taking the time out to place the hair clipper aside or store it uncomfortably in a pocket, where the clipper could fall out and become damaged.

Therefore, there is a need for a battery-powered hand-held hair clipper that is lightweight, compact and has an increased run time. There is also a need for a battery-powered hair clipper that allows a stylist to readily move from one task to another with ease and efficiency. Finally, there exists a need for a battery-powered hand-held hair clipper that can be carried by the user without hampering mobility or comfort.

BRIEF SUMMARY OF THE INVENTION

The above-listed needs are met or exceeded by the present belt or clothing-mountable battery-powered hair clipper assembly. The present hair clipper assembly provides a lightweight, modular system for cutting hair that is attachable to a user's clothing at several designated locations, such as the pocket, waist, belt or sleeve. The present assembly allows the user to work on two-to-three clients at various stages in the styling process at the same time, increasing the efficiency of the user. The present assembly also optionally allows the user to continue working while the hair clipper is being recharged, again increasing efficiency because the user does not have to wait until the clipper battery is fully charged for it to be operable. In addition, in one embodiment the present hair clipper assembly is not tethered to the wall, and can even be operated without a cord, thereby increasing the user's mobility.

Specifically, the present hair clipper assembly configured for attachment to a user includes a battery pack having a housing, at least one battery, a belt clip, and a holster recess; a holster having a belt clip; a hair clipper configured to slidably fit within the holster; and a cord connecting the clipper to the battery pack.

In addition, the present hair clipper assembly provides a system for clipping hair that includes a battery pack having a housing, at least one battery, and a belt clip configured for attachment to a user; a holster having a holster belt clip, where the holster belt clip is selectively attachable to the battery pack and to the user; a hair clipper configured to slidably fit within the holster; and a cord connecting the hair clipper and the battery pack.

In another embodiment, a hair clipper assembly configured for attachment to a user includes a battery pack having a housing, at least one battery, a belt clip, and a holster recess; a holster having a holster belt clip; and a hair clipper configured to slidably fit within the holster. The hair clipper has a housing, an in-unit battery, a blade end, a back end, and a back end receptacle; and a cord having a first end connected to the battery pack and a second end configured for removable insertion into the back end receptacle for recharging the battery in the hair clipper.

DESCRIPTION OF THE SEVERAL VIEWS OF THE DRAWINGS

FIG. 1A is a fragmentary perspective view of an alternate embodiment of the assembly of FIG. 1;

DETAILED DESCRIPTION OF THE PREFERRED EMBODIMENT

Figure 1:
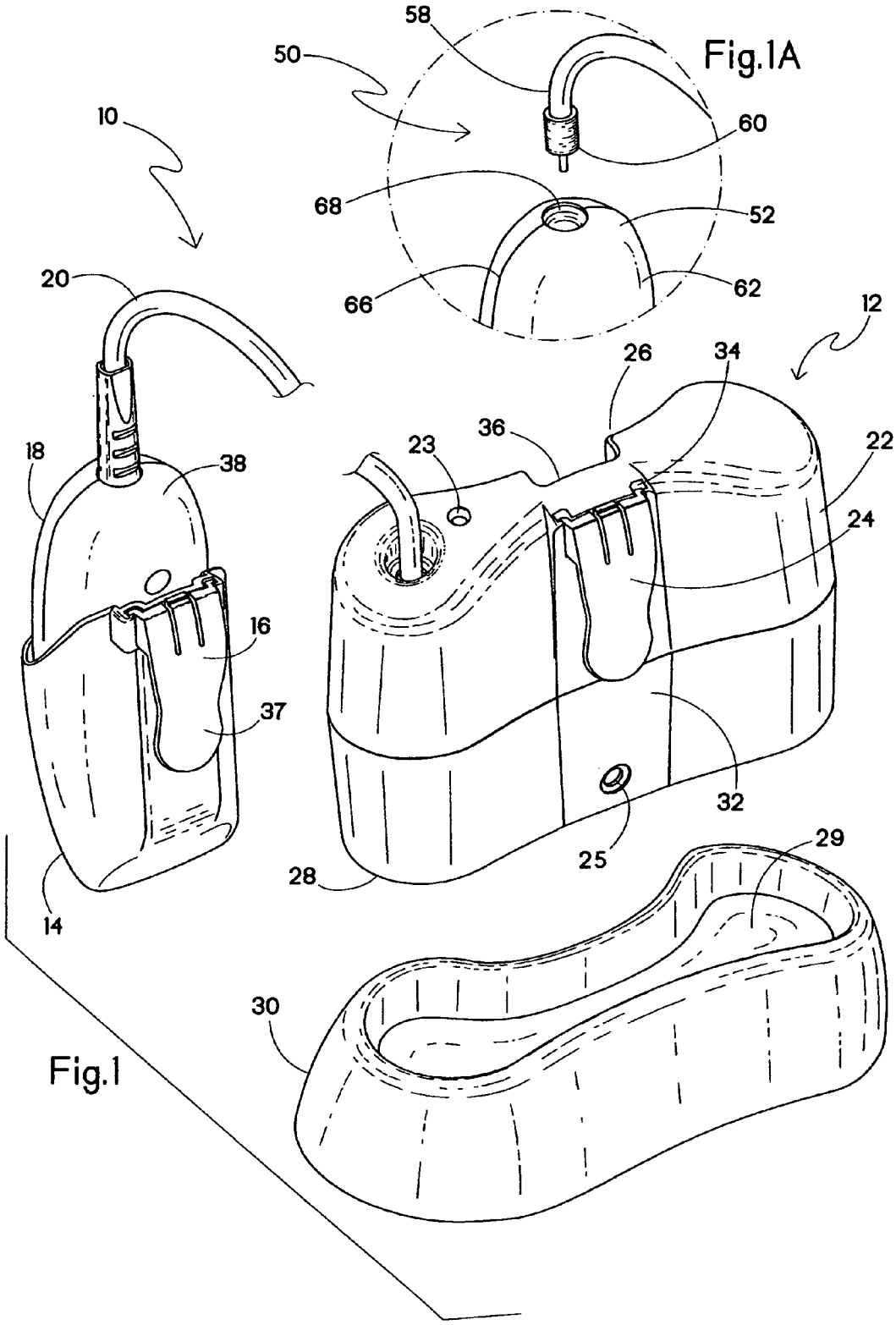
FIG. 1 is an exploded top perspective view of the present hair clipper assembly with the holster detached from the battery pack and depicting a battery charging stand.

Referring now to FIG. 1, a belt or clothing-mountable battery-powered hair clipper assembly according to the present invention is generally designated 10. The assembly 10 includes a battery pack that is generally designated 12, a holster 14 having a holster belt clip 16, a hair clipper 18 configured to slidably fit within the holster, and a power cord 20 connecting the clipper to the battery pack.

Figure 3:
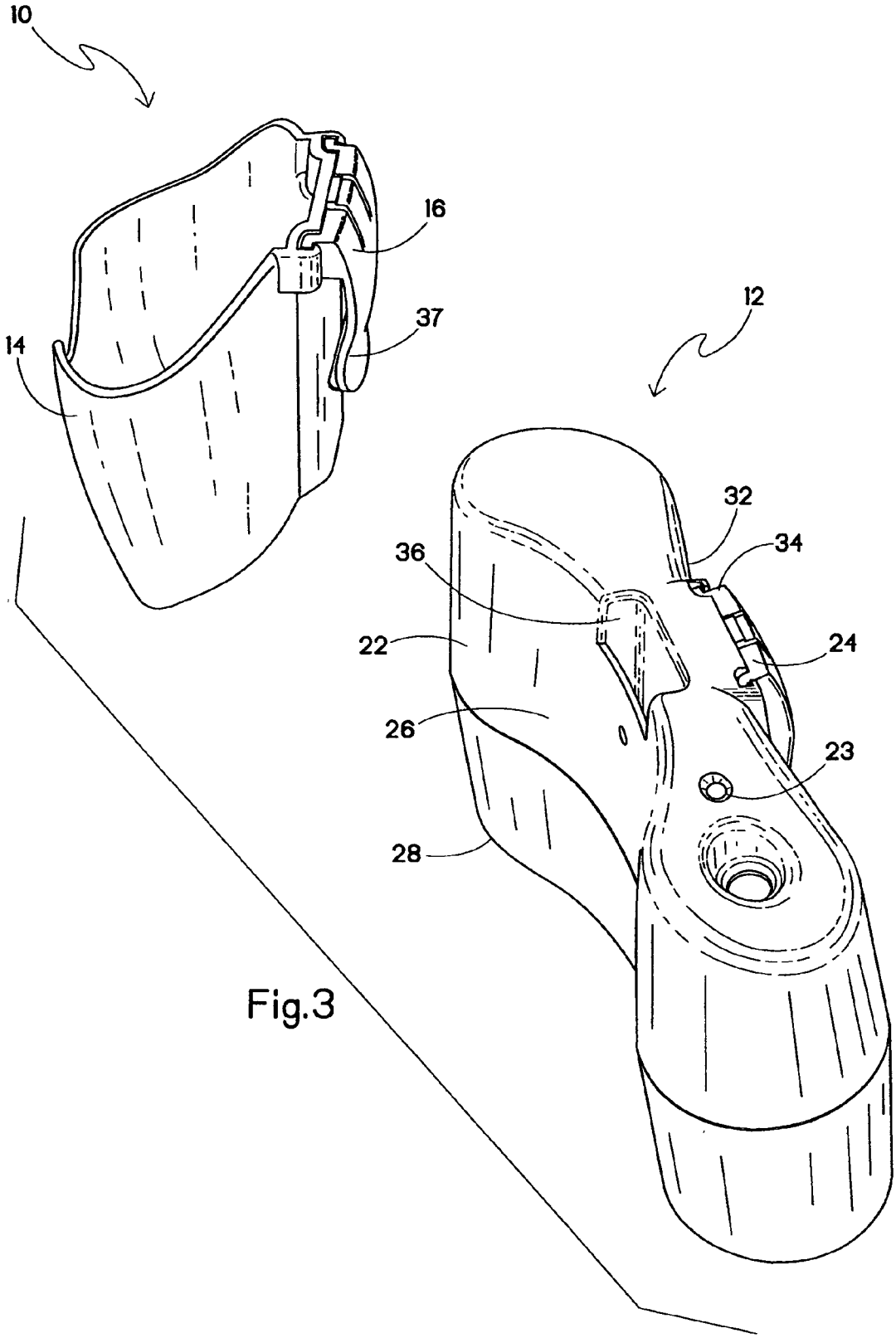
FIG. 3 is an exploded top perspective view of the holster and the battery pack of the present hair clipper assembly.

The battery pack 12 includes a housing 22, an LED indicator 23 located on the housing, at least one battery (not shown), a belt clip 24, and a holster recess 26 (best seen in FIG. 3). To recharge the hair clipper assembly 10, a transformer plug-in 25 is located in the back of the battery pack 12. When the assembly 10 needs to be recharged, it is contemplated that a transformer plug (not shown) can be inserted into the plug-in 25, facilitating electrically-powered recharging of the assembly. It is also contemplated that the assembly 10 can be recharged by alternative means.

For example, referring to FIG. 1, an alternative method of facilitating recharging of the hair clipper assembly 10 is shown. The battery pack housing 22 further includes a base 28, which is configured to be inserted into a recess 29 in a battery-charging stand 30. As is known in the art, contacts 31 (best seen in FIGS. 4 and 5) engage corresponding contacts (not shown) on the stand 30 for recharging purposes. It is contemplated that the battery pack 12 will provide a longer run time for the hair clipper 18, because it is of a larger size than the in-unit batteries that are currently used in hand-held hair clippers. It is contemplated that the battery pack 12 can operate for a full 8-hour workday without needing to be recharged. It is further contemplated that because the battery pack 12 is provided as a separate unit from the hair clipper 18, the clipper is of a lighter weight than prior battery-powered hand-held hair clippers with in-unit batteries. Thus, the hair clipper 18 is easier to manipulate during operation and reduces operator fatigue.

Figure 2:
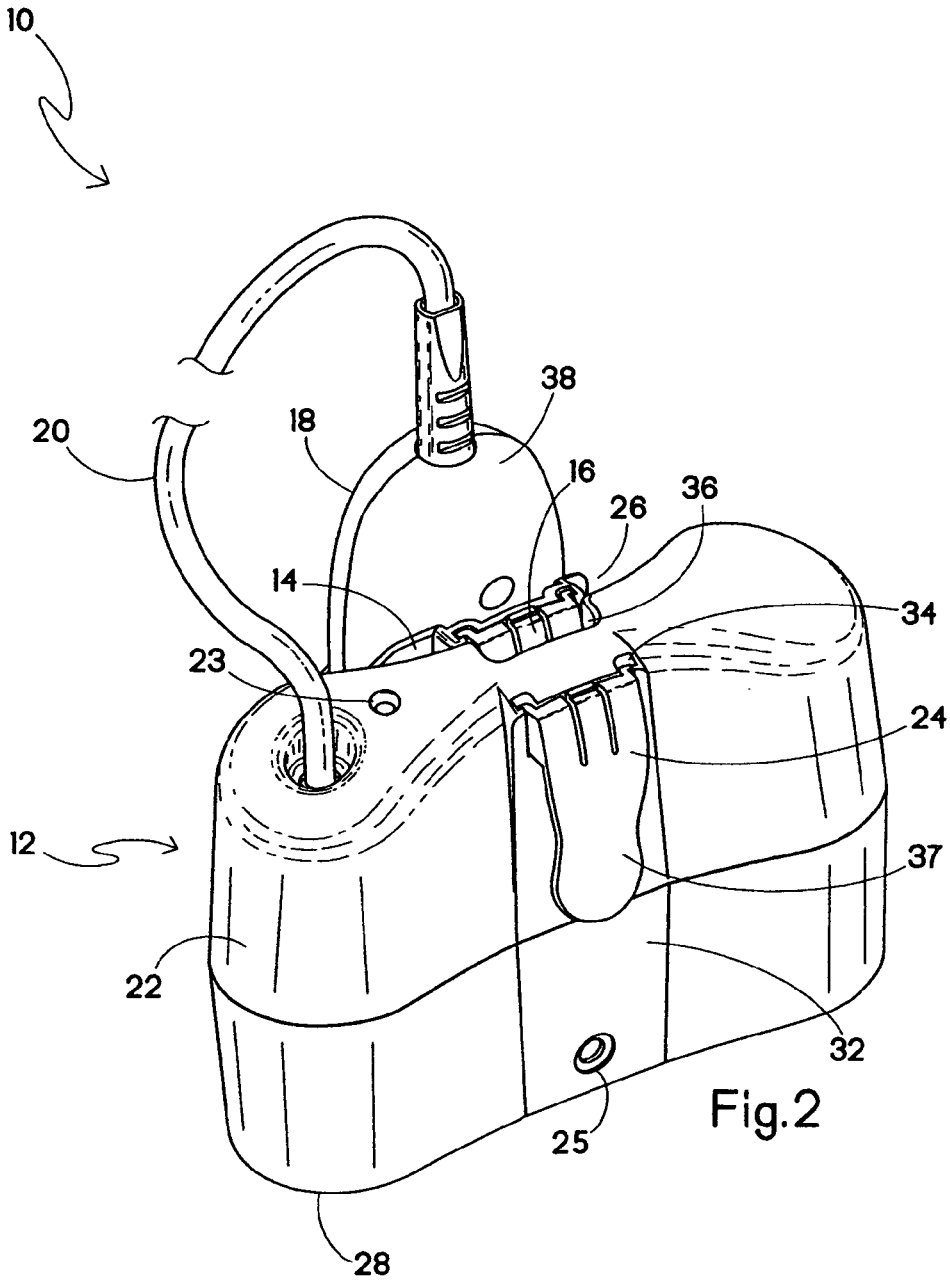
FIG. 2 is a top perspective view of the present hair clipper assembly with the holster attached to the battery pack.

Referring to FIGS. 1-3, the battery pack 12 further includes a clip recess 32 that is generally centrally located in the battery pack housing 22. The clip recess 32 contains a clip recess opening 34 that is configured for receiving the belt clip 24. It is contemplated that the clip recess opening 34 is generally centrally located in the clip recess 32, however other locations are contemplated. The belt clip 24 is inserted into and secured in the clip recess opening 34 by at least one lug (not shown), or chemical adhesives, ultrasonic welding, insert molding fasteners or other known fastening technologies.

Referring now to FIGS. 1 and 3, the holster 14 is configured to engage with and be slidably received in the holster recess 26. The holster recess 26 is generally centrally located in the battery pack housing 22, opposite the clip recess 32. The holster recess 26 includes a generally centrally located holster recess opening 36, best seen in FIG. 3. The holster recess opening 36 is configured to receive the holster belt clip 16. The holster belt clip 16 is secured to the holster 14 by at least one lug (not shown) or other technology described above, preferably in the same manner as the belt clip 24 is secured to the clip recess opening 34. It is contemplated that the at least one lug used to secure the holster belt clip 16 and the at least one lug used to secure the belt clip 24 are identical, however as described above, other fastening technologies are contemplated. It is further contemplated that the clip recess 32 and the holster recess 26 are configured to be in alignment, although it is appreciated that other arrangements are possible.

Figure 5:
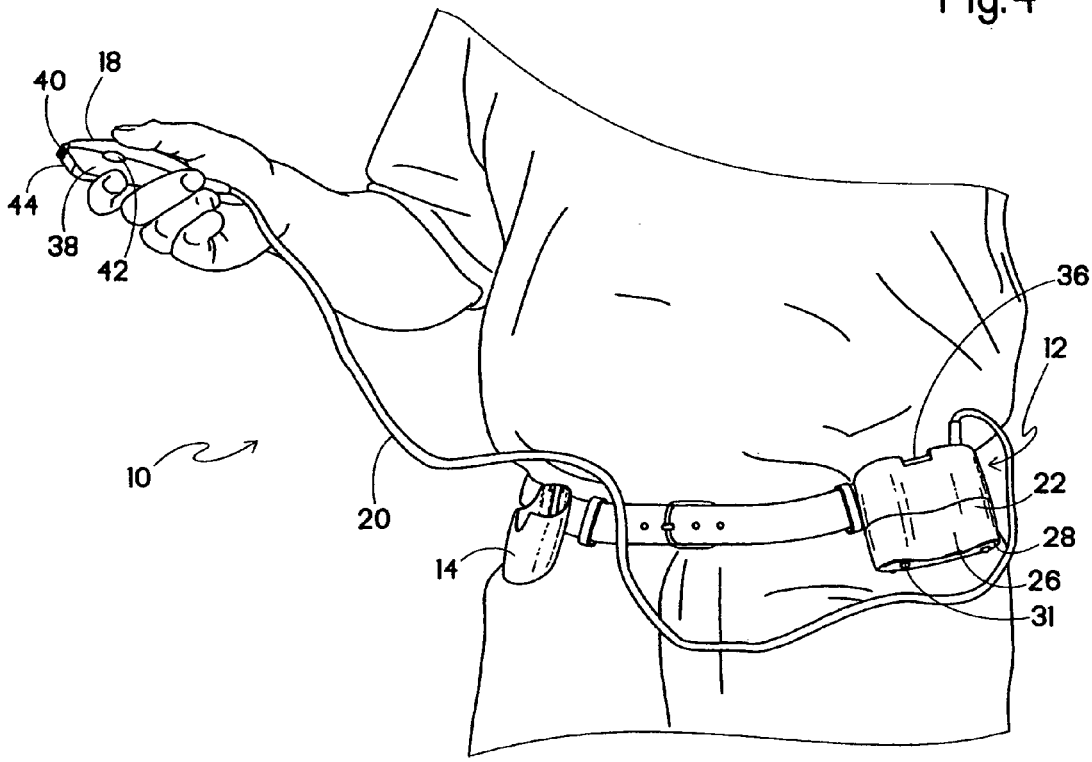
FIG. 5 is a perspective view of the present hair clipper assembly with the holster and battery pack attached separately to the user in a second orientation.

Referring to FIGS. 2 and 3, the holster recess 26 is generally configured to accommodate the shape of the holster 14. It is further contemplated that through the holster belt clip 16, the holster 14 is designed to be releasably and slidably attachable to the holster recess opening 36. A tang 37 of the holster belt clip 16 is matingly engageable in the recess opening 36. When the holster 14 is detached, it can then be attached to a user independent from the battery pack 12, as seen in FIG. 5. As referred to in the present application, "attachment to a user" will be understood to mean attachment to a user's clothing. Because of the relatively small size and light weight of the holster 14, it is contemplated that it can be attached to the user at several different locations, such as the user's pocket, waist, belt or sleeve, without inhibiting the user's mobility or comfort.

Figure 4:
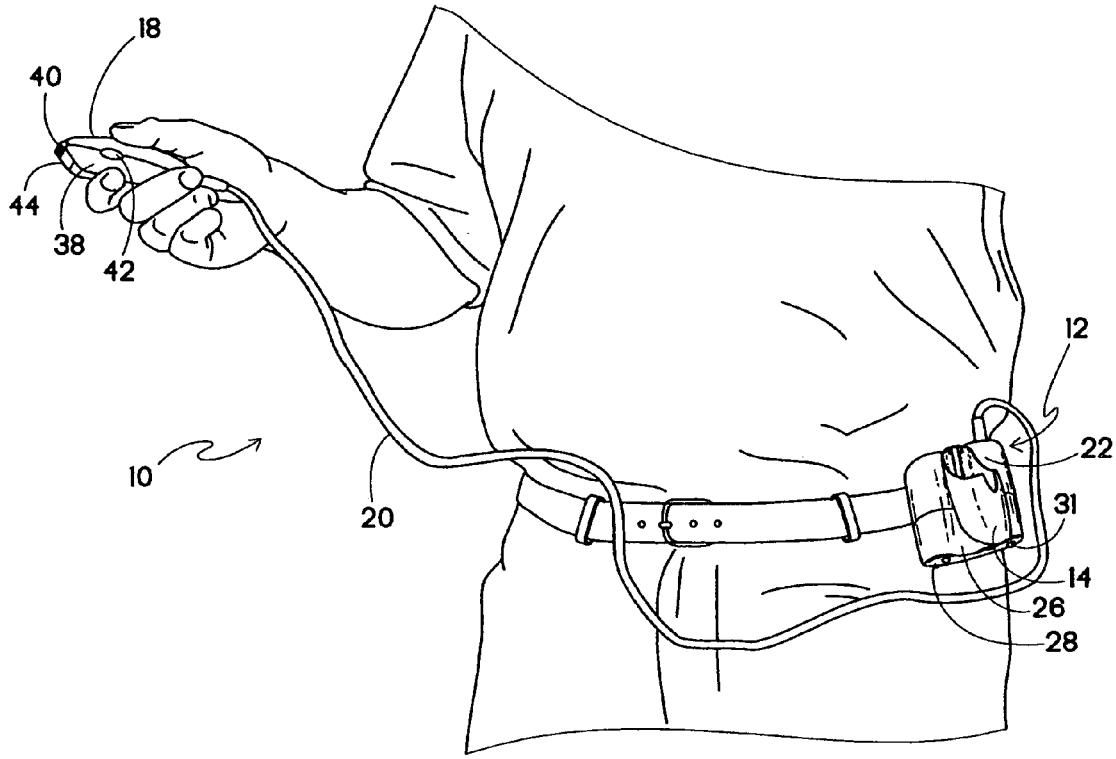
FIG. 4 is a perspective view of the present hair clipper assembly attached to a user in a first orientation.

Referring to FIGS. 2, 4 and 5, the hair clipper 18 is configured to be slidably inserted into and removed from the holster 14. The hair clipper 18 is manufactured as is known by those in the art, and generally includes a housing 38, a bladeset 40 typically including a moving blade and a stationary blade as is well known in the art, and a switch 42. The hair clipper 18 is configured to be inserted into the holster 14, with a blade-end 44 being inserted first. It is contemplated that inserting the hair clipper 18 into the holster 14 in this direction will protect the bladeset 40 from becoming caught on the user's clothing or will prevent dust or other particles from getting inside the bladeset.

As seen in FIGS. 4 and 5, the clip recess 32 is configured to conform to the contour of the user's waist. Because the clip recess 32 is generally centrally located in the battery pack 12, and is generally symmetrical on either side of the clip recess opening 34, it is contemplated that the battery pack 12 is attachable to either side of the user's body, allowing both left-handed and right-handed stylists to use the clipper assembly 10 with the same amount of ease and comfort.

Referring to FIGS. 2, 4 and 5, the cord 20 of the present assembly 10 maintains a connection between the hair clipper 18 and the battery pack 12. The cord 20 is constructed and arranged to extend out of the clipper 18 from the end opposite the bladeset 40. It is contemplated that the cord 20 provides for a more modular assembly 10 increasing the user's freedom of mobility, because the cord is not tethered to a wall outlet. It is further contemplated that because the cord 20 remains in close proximity to the user during operation, rather than being located away from the user and plugged into a wall outlet, a shorter cord 20 may be provided, either straight or coiled, resulting in a reduced chance of the cord becoming tangled or caught.

Referring now to FIGS. 4 and 5, the present belt-mountable battery-powered hair clipper assembly 10 also can be characterized as a system for clipping hair. The system includes the battery pack 12, the holster 14 having the holster belt clip 16, the hair clipper 18 configured to slidably fit within the holster, and the cord 20 electrically connecting the hair clipper and the battery pack.

The holster 14 of the system is configured to be easily detachable from and attachable to the battery pack 12 because of the holster recess 26, which is configured to conform to the shape of the holster 14, thereby facilitating smooth interactions between the holster and the battery pack. It is contemplated that after the holster 14 has been detached, it can be attached to several holster locations on the user. For instance, the holster 14 can be attached to the side of the user that is opposite from the battery pack 12, as seen in FIG. 5. In another instance, the holster 14 can be attached to the user adjacent the battery pack 12. In yet another instance, the holster 14 can be attached to a user's shirt or pants pocket. It should be appreciated that the holster locations are not limited to those disclosed above, and that other locations are possible, depending on the needs of the user and the particular application.

The battery pack 12 of the system is also configured for attachment to selected pack locations on a user's body. The pack locations can be either remote or adjacent to the holster locations. Because of the clip recess 32, the battery pack 12 is configured to easily conform to the shape of the user's body at several different locations. For example, the battery pack 12 can be attached to the user on the side of the body opposite the holster 14. In addition, the battery pack 12 can be attached to the back of the user's body so that it is out of the way of the user. In this instance, the holster 14 can be attached to the front of the user so that the user still has access to the clipper 18. Although only a few battery pack locations have been mentioned herein, it is appreciated that other locations are possible, based on the needs of the user.

The cord 20 of the present system is designed to maintain an electrical connection between the hair clipper 18 and the battery pack 12, regardless of the relative positions of the battery pack and the holster 14 on the user's body. Unlike an electrical hair clipper powered by line voltage, which can become detached from the wall if the user ventures too far away from the outlet, it is contemplated that the cord 20 of the present system will maintain a connection regardless of the movement of the user or the positions of the holster 14 and the battery pack 12 on the user's body or clothing.

Figure 6:
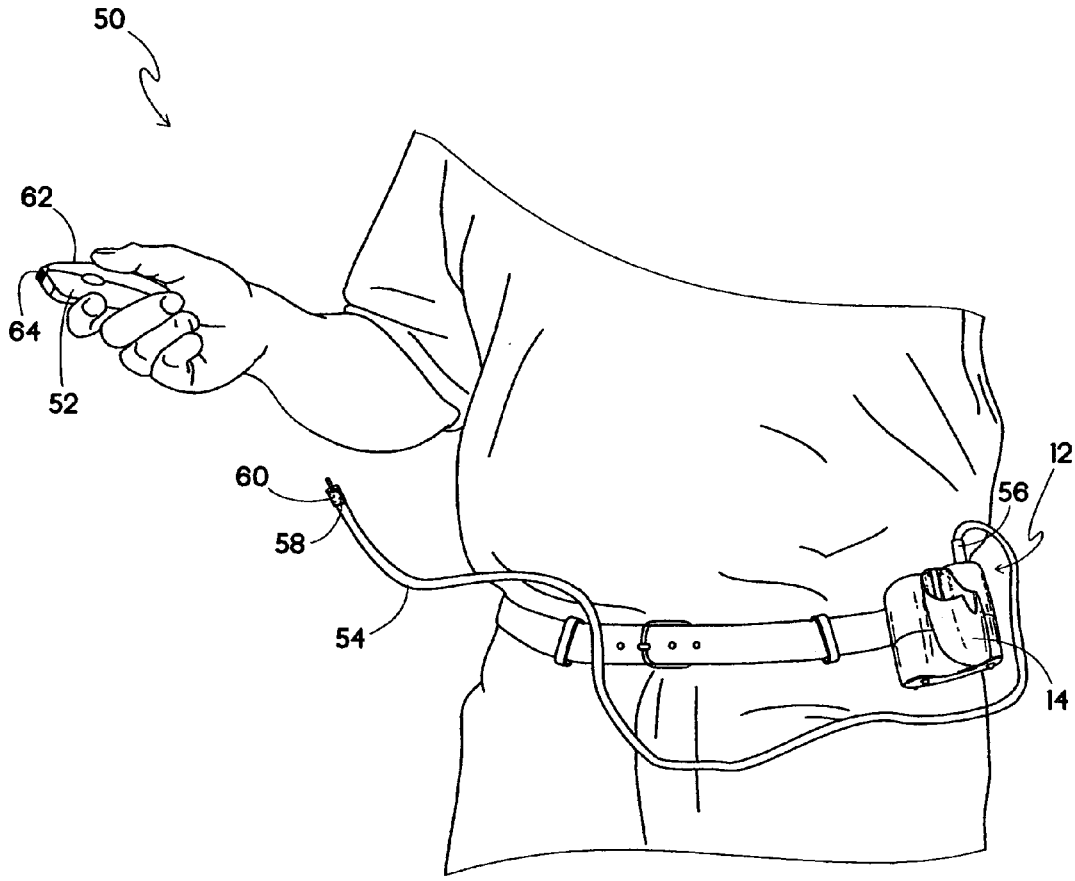
FIG. 6 is a perspective view of the alternate embodiment of FIG. 1A.

FIGS. 1A and 6 show an alternate embodiment of the present hair clipper assembly, generally designated 50. Components shared with the assembly 10 are designated with the same reference numbers. The assembly 50 includes the battery pack generally designated 12, the holster 14, the holster belt clip 16 (not shown), a clipper 52 configured to slidably fit within the holster, and a power cord 54 having a first end 56 and a second end 58.

The first end 56 of the cord 52 is configured for attachment to the battery pack 12. It is contemplated that the cord 52 can be either coiled or straight, depending on the needs of the user. The second end 58 of the cord 52 includes a plug 60 that is configured for providing an electrical connection between the clipper 52 and the battery pack 12. To facilitate this connection, the clipper 52 includes a housing 62, a blade end 64, a back end 66 and a back end receptacle 68. The back end receptacle 68 is configured for receiving, and electrical connection with the plug 60, best seen in the detailed inset of the clipper shown in FIG. 1A. It is contemplated that the plug 60 can be easily inserted into and removed from the back end receptacle 68, allowing the clipper 52 to operate whether or not an attachment to the battery pack 12 exists.

To facilitate use of the clipper 52 independently of the battery pack 12, the clipper further includes a small in-unit battery (not shown). The in-unit battery allows the clipper 52 to operate when the plug 60 is detached from the back end receptacle 68 of the clipper. Therefore, the clipper 52 can be operated without the need of the cord 54, increasing the user's mobility and range of movement when operating the clipper. It is contemplated that the in-unit battery of the clipper 52 has a run-time of approximately ten minutes before it needs to be recharged. It is also contemplated that the in-unit battery provides approximately 400-500 milliamps of power. It is further contemplated that because of the light weight and small size of the in-unit battery, the clipper 52 remains lightweight and compact compared to conventional hand-held clippers.

Referring still to FIGS. 1A and 6, to facilitate recharging of the clipper 52, the user need only insert the plug 60 into the back end receptacle 68 of the clipper, thus providing an electrical connection between the battery pack 12 and the clipper. It is contemplated that this method of recharging is advantageous over past hand-held clipper assemblies because the user can still operate the clipper 52 while the in-unit battery is being recharged. In addition, because the battery pack 12 is not tethered to the wall during recharging of the clipper 52, the user is not limited in their movement during recharging. This increases the efficiency of the user, because the clipper 52 is operable during recharging of the battery, and the user's mobility is not hindered during recharging.

It is further contemplated that after the clipper 52 has been recharged, it can be detached from the cord 54, allowing the clipper 52 to operate again for approximately ten minutes independent of any connection to the battery pack 12. This process can be repeated as many times as necessary, without the need for the user to ever completely stop the operation of the clipper 52, until the battery pack 12 is fully discharged. It is contemplated that this will increase the ability of the user to multi-task and to be more efficient in the workplace, because there is no need to wait for the clipper to be recharged before it can be used.

While a particular embodiment of the present belt-mountable battery-powered hair clipper with holster has been described herein, it will be appreciated by those skilled in the art that changes and modifications may be made thereto without departing from the invention in its broadest aspects and as set forth in the following claims.

The invention claimed is:

1. A system for clipping hair, comprising:

a battery pack having a housing, at least one battery, a clip recess generally centrally located in a back sidewall of said housing, and having a battery belt clip configured for attachment to a user's clothing;

said clip recess having a clip recess opening, said battery belt clip is configured for insertion into said clip recess opening;

said battery pack having a holster recess generally centrally located in a front sidewall of said housing, said holster recess having a holster recess opening;

a holster having a holster belt clip, wherein said holster belt clip is selectively attachable in said holster recess opening and to the user's clothing;

a hair clipper configured to slidably fit within said holster; and a cord connecting said hair clipper and said battery pack;

wherein said clip recess and said holster recess are in registry with each other such that said recesses are aligned with and oppositely located from each other, said clip recess is generally symmetrical on either side of said clip recess opening and said holster recess is configured for facilitating equivalent access to said assembly by left- and right-handed users.

2. The system of claim 1 wherein said holster is configured to be detachable from said battery pack.

3. The system of claim 2 wherein said holster is configured for attachment to selected holster locations on the users's clothing.

4. The system of claim 1 wherein said battery pack is configured for attachment to selected pack locations on the user's clothing, said pack locations being remote or adjacent to said holster locations.

5. The system of claim 1 wherein said cord maintains an electrical connection between said hair clipper and said battery pack, regardless of relative positions of said battery pack and said holster on the user's clothing.

* * * * *

UNITED STATES PATENT AND TRADEMARK OFFICE

CERTIFICATE OF CORRECTION

PATENT NO. : 7,356,934 B2
APPLICATION NO. : 10/999042
DATED : April 15, 2008
INVENTOR(S) : McCambridge et al.

It is certified that error appears in the above-identified patent and that said Letters Patent is hereby corrected as shown below:

Col. 6, line 54, delete “users’s” and insert --user’s--

Signed and Sealed this

Second Day of September, 2008

JON W. DUDAS
*Director of the United States Patent and Trademark Office*